US009793668B1

(12) United States Patent
Peng

(10) Patent No.: US 9,793,668 B1
(45) Date of Patent: Oct. 17, 2017

(54) E26 PLASTIC LAMPHOLDER

(71) Applicant: Rich Brand Industries Limited, Dongguan, Guangdong Province (CN)

(72) Inventor: Te-Shui Peng, Taoyuan (TW)

(73) Assignee: Rich Brand Industries Limited, Dongguan (CN)

( * ) Notice: Subject to any disclaimer, the term of this patent is extended or adjusted under 35 U.S.C. 154(b) by 0 days.

(21) Appl. No.: 15/355,126

(22) Filed: Nov. 18, 2016

(51) Int. Cl.

| | |
|---|---|
| ***H01K 1/46*** | (2006.01) |
| ***H01R 33/22*** | (2006.01) |
| ***H01R 13/73*** | (2006.01) |
| ***F21S 8/02*** | (2006.01) |
| ***F21V 23/06*** | (2006.01) |
| ***F21V 23/00*** | (2015.01) |
| ***F21V 19/00*** | (2006.01) |

(52) U.S. Cl.
CPC ..... *H01R 33/22* (2013.01); *F21S 8/026* (2013.01); *F21V 19/006* (2013.01); *F21V 23/001* (2013.01); *F21V 23/06* (2013.01); *H01R 13/73* (2013.01)

(58) Field of Classification Search
CPC ..... H01R 33/971; H01R 33/94; H01R 33/22; H01R 13/748; H01R 4/2404; H01K 1/465; H01K 1/46
USPC ..... 439/615, 306, 340; 362/412, 362
See application file for complete search history.

(56) References Cited

U.S. PATENT DOCUMENTS 5,569,044 A * 10/1996 Huang ..... H01R 33/22 439/340
5,702,267 A * 12/1997 Chen ..... F21V 21/002 439/340
5,702,268 A * 12/1997 Lien ..... H01R 33/22 439/340
5,722,853 A * 3/1998 Hwang ..... F21V 21/002 439/340

* cited by examiner

*Primary Examiner* — Hien Vu
(74) *Attorney, Agent, or Firm* — Alan D. Kamrath; Kamrath IP Lawfirm, P.A.

(57) ABSTRACT

An E26 plastic lampholder is composed of a housing, a plastic bracket, a plastic threaded ring, a positive electrode plate and a negative electrode plate and installed to a downlight. The lampholder has two wire plug slots for plugging two electrodes of a power line by a bare line section, so that a power source is introduced with a convenient operation. The plastic bracket and the housing of the E26 plastic lampholder are made of a plastic material, and a combining groove is reserved on the housing 1 and provided for installing and positioning the plastic bracket, or the housing and the plastic bracket are integrally formed for a more convenient assembling operation. In the meantime, the plastic threaded ring of the E26 plastic lampholder is integrally formed in the housing, so as to facilitate the manufacturing and assembling processes.

3 Claims, 7 Drawing Sheets

E26 PLASTIC LAMPHOLDER

BACKGROUND OF THE INVENTION

Field of the Invention

The present invention relates to a lampholder, and more particularly to the E26 plastic lampholder that can be manufactured, assembled and electrically connected more conveniently.

Description of the Related Art

Bright light is a driving force for improvements in all aspects of human activities. Without the invention of bright lights (such as light bulbs) and a series of subsequent improvements and modifications, human beings cannot have such rapid advancement in all aspects. The introduction of tungsten light bulbs was a great invention of mankind, In the principle of the tungsten light bulbs, the resistance of an electrical conduction is used to heat a tungsten filament to incandescence, so as to emit light, since an amount of over 90% of the electric energy consumed by the tungsten light bulb is converted into heat energy, and only an amount of 10% of the electric energy is used for emitting light. Obviously, the tungsten light bulbs have the drawbacks of high power consumption and low luminous efficiency. In recent years, government and private sectors of different countries in the world spare no effort to implement power saving and carbon reduction to maximize the utility of global resources and protect the ecology and environment instead of overdeveloping them. Particularly, in the aspect of illumination, various different power-saving fluorescent light bulbs and LED light bulbs are developed to replace the traditional tungsten light bulbs having the drawbacks of high power consumption and low luminous efficiency.

In a home environment, there is a "downlight" generally installed and used at home, and the downlight is a lamp embedded into a sealed ceiling. The conventional tungsten light bulb is generally installed in the downlight and used for the purpose of illumination. Since the environment using the downlight is sealed and the tungsten light bulb generates much heat, therefore the chance of burning the construction material such as the ceiling material becomes greater, and thus the downlight becomes a potential danger to the home environment. Therefore, the downlight is gradually replaced by a cold light illumination series. In other words, the power saving fluorescent light bulb and the LED light bulb are used as a light source to substitute the downlight.

The structure of a downlight is generally composed of a lamp body and a lampholder, wherein the lamp body is a shell object having an accommodating space formed therein. During assembling, the lamp body is embedded into an embedding hole formed on the ceiling to achieve the embedding and positioning effects. The bottom of the lamp body (that faces users) may be sealed by a cover or opened without having a cover, and the top of the lamp body is opened and slightly tapered to form an accommodating slot. The lampholder can be installed, fixed, and positioned into the accommodating slot, and the lampholder is provided for connecting a power line at the top and connecting a light bulb at the bottom. Therefore, the downlight can emit light downwardly from the light bulb, and then scatter downwardly in a range surrounding the lamp body to provide illumination, since the lampholder of the downlight generally has a specification of E26, therefore such lampholder is called an E26 lampholder.

With reference for FIGS. 1 and 2 for a conventional lampholder 10 installed in a downlight, the conventional lampholder 10 is basically comprised of a housing 11, a metal bracket 12 and a metal threaded ring 13, wherein the housing 11 is made of a high temperature resistant ceramic material and formed into a cylindrical shape, and the top of the housing 11 is divided into positive and negative conductive lines 111 by a screwing or riveting means and the bottom of the housing 11 is opened inwardly; the metal bracket 12 is made of a flexible metal steel and divided into a roof portion 121 and two elastic board parts 122 disposed on both sides of the metal bracket 12 respectively, and the roof portion 121 is fixed to the top of the housing 11 (by the screwing or riveting means) for the assembling, so that the two elastic board parts 122 are extended slantingly outwardly from both sides of the housing 11 (as shown FIG. 1); the metal threaded ring 13 is installed from the bottom of the housing 11 and coupled to the conductive line 111 of one of the electrode (negative electrode) of the metal threaded ring 13, so that the conductive line 111, the housing 11 and the metal threaded ring 13 are fixed to one another through the aforementioned screwing or riveting means, and the conductive line 111 of the other electrode (positive electrode) is coupled to a cathode conductive plate 112 by the screwing or riveting means (as shown in FIG. 1), and the cathode conductive plate 112 is independently situated within an open range at the top of the metal threaded ring 13.

After the downlight is assembled, the lampholder 10 is installed and positioned in the accommodating slot at the top of the lamp body of a downlight, so that the elastic board parts 122 disposed on both sides of the metal bracket 12 is latched to the wall of the accommodating slot at the top of the lamp body, so as to achieve the effect of securely fixing the lampholder 10 to the accommodating slot at the top the lamp body. When the whole downlight is installed to the ceiling, the lamp body of the downlight is embedded into the embedding hole formed on the ceiling, and the downlight is secured installed to the embedding hole by a latching means; then the conductive lines 111 are electrically connected and conducted with two electrodes of a power line connected to the mains power, so that a switch on the wall which is connected to the power lines may be used to control and turn on/off the power supply; and finally the light bulb is installed by extending the light bulb from the bottom of the lamp body, and a threaded joint screw of the light bulb is installed and secured into the metal threaded ring 13 of the lampholder 10. Now, the top of the threaded joint screw of the light bulb abuts against the cathode conductive plate 112 to electrically conduct the conductive line 111 of the positive electrode, and the threaded portion of the threaded joint screw of the light bulb is electrically conducted with the conductive line 111 of the negative electrode through the metal threaded ring 13.

The conventional lampholder 10 is a product that has been in existence for a longtime, and its housing 11 is made of a high temperature resistant ceramic material to resist the large amount of heat generated by the tungsten light bulb. However, the power saving fluorescent light bulb and LED light bulb (cold light illumination series) are used as a light source of the downlight instead. In summation, the conventional lampholder 10 has the following drawbacks and requires improvements.

1. The conventional lampholder 10 must have the positive and negative conductive lines 111 connected to the top of the housing 11 by a screwing or riveting means, and the conductive lines 111 are electrically conducted with the electrodes of the power line of the mains power respectively, and such structure and connection method are complicated.

2. In the design of the conventional lampholder 10, the roof portion 121 of the metal bracket 12 and the top of the housing 11 are fixed by a screwing or riveting means, and such structure and connection method are also complicated.

3. In the design of the conventional lampholder 10, the metal threaded ring 13 and the housing 11 are connected, and then the metal threaded ring 13 carries the threaded joint screw of the light bulb, and such structure and connection method are also complicated.

SUMMARY OF THE INVENTION

In view of the aforementioned drawbacks of the prior art, the inventor of the present invention conducted researches and experiments, and finally developed an E26 plastic lampholder in accordance with the present invention to overcome the drawbacks of the prior art.

Therefore, it is a primary objective of the present invention to provide an E26 plastic lampholder that can be connected to a power supply more conveniently for its use on a downlight.

Another objective of the present invention is to provide an E26 plastic lampholder that makes the assembling and operation of a housing and a plastic bracket more conveniently for its use on a downlight.

A further objective of the present invention is to provide an E26 plastic lampholder wherein a plastic threaded ring is directly and integrally formed with a housing to facilitate the manufacturing and assembling process for its use on a downlight.

To achieve the aforementioned and other objectives, the present invention discloses an E26 plastic lampholder comprising a housing, a plastic bracket, a plastic threaded ring, a positive electrode plate and a negative electrode plate, wherein the housing is made of a plastic material and has an opening bottom inwardly penetrated to form an accommodating space, two latch slots symmetrically formed at the inner top of the housing, two wire plug slots formed on both sides of the top of the housing respectively and communicated with a latch slot separately, and a vertical shallow groove concavely formed on an internal wall of the housing; the plastic bracket is made of a plastic material and comprises a horizontal roof portion and two elastic board parts extended towards both sides, and the roof portion is coupled to the top of the housing, so that the two elastic board parts are slantingly extended to both sides of the housing respectively; the plastic threaded ring is a threaded notch integrally formed on an internal wall of the housing and the plastic threaded ring breaks its extension at the shallow groove and recurs after crossing the shallow groove; the positive electrode plate is made of an electrically conductive material and has a conductive protruding portion which makes an arc turn of substantially 180° after extending for a small section and then bends upwardly to form a vertical wall after extending for a small section, and a stop plate is stamped on the vertical wall, and an upper end of the vertical wall is turned in the opposite direction and extended to form an slantingly installed electric connection plate, and a latch recess is stamped at the front end of the electric connection plate, and the positive electrode plate is accommodated in the accommodating space of the housing, so that the electric connection plate and the vertical wall enter into one of the latch slots, and the latch recess of the electric connection plate is aligned precisely with one of the wire plug slots, and the stop plate on the vertical wall abuts against the latch slot wall to stop and position the positive electrode plate, while the conductive protruding portion on the positive electrode plate is extended to the center of an upper portion of the accommodating space; the negative electrode plate is made of an electrically conductive material and has a conductive bent portion which is bent and extended for a small section after being stretched upwardly, and then further bent upwardly to form a vertical wall, and a stop plate is stamped on the vertical wall of the negative electrode plate, and an upper end of the vertical wall of the negative electrode plate is then turned in the opposite direction and extended to form a slantingly installed electric connection plate, and a latch recess is stamped from a front end of the electric connection plate of the negative electrode plate, and the negative electrode plate is accommodated in the accommodating space of the housing, so that the electric connection plate of the negative electrode plate and the vertical wall enter into another latch slot, and the latch recess on the electric connection plate of the negative electrode plate is aligned precisely with the other wire plug slot, and the stop plate on the vertical wall of the negative electrode plate abuts against the latch slot wall to stop and position the negative electrode plate while a plate disposed on the negative electrode plate and at a position where the conductive bent portion is disposed extends downwardly and stays in the shallow groove of the housing.

In the E26 plastic lampholder, the housing has a horizontal combining groove formed in the middle of the top of the housing and a combining slot formed at the center of the housing, and the plastic bracket has a combining perforation formed at the center of the plastic bracket, and the roof portion of the plastic bracket is contained in the combining groove of the housing, so that the combining perforation of the plastic bracket is aligned precisely with the combining slot of the housing, and an engaging member is passed through the combining perforation and the combining slot to couple the plastic bracket with the housing.

In the E26 plastic lampholder, the housing, the plastic bracket and the plastic threaded ring are made of a plastic material and integrally formed.

DETAILED DESCRIPTION OF THE PREFERRED EMBODIMENTS

Figure 1:
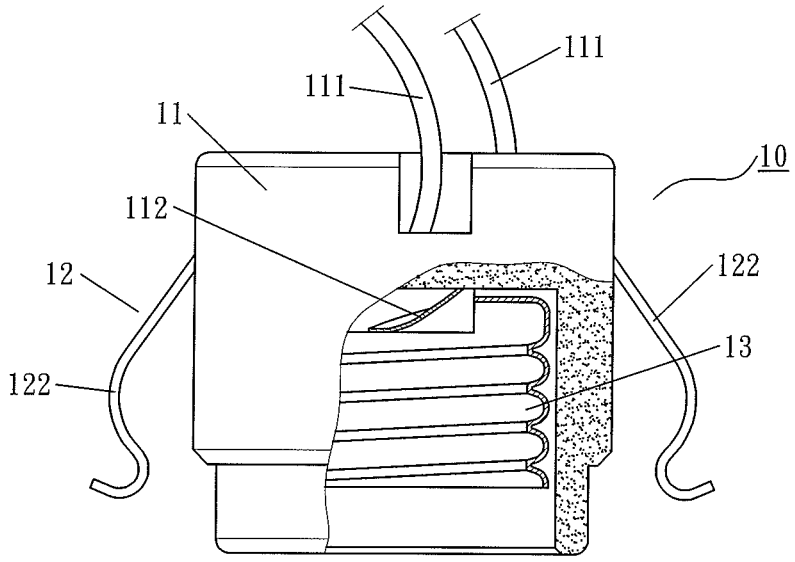
FIG. 1 (PRIOR ART)
FIG. 1 is a partial sectional side view of a conventional lampholder.
Figure 2:
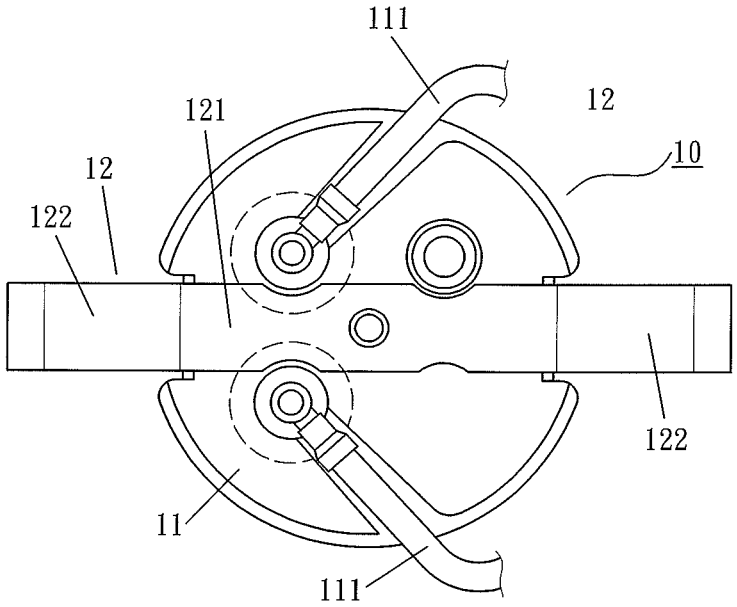
FIG. 2 (PRIOR ART)
FIG. 2 is a top view of a conventional lampholder.
Figure 3:
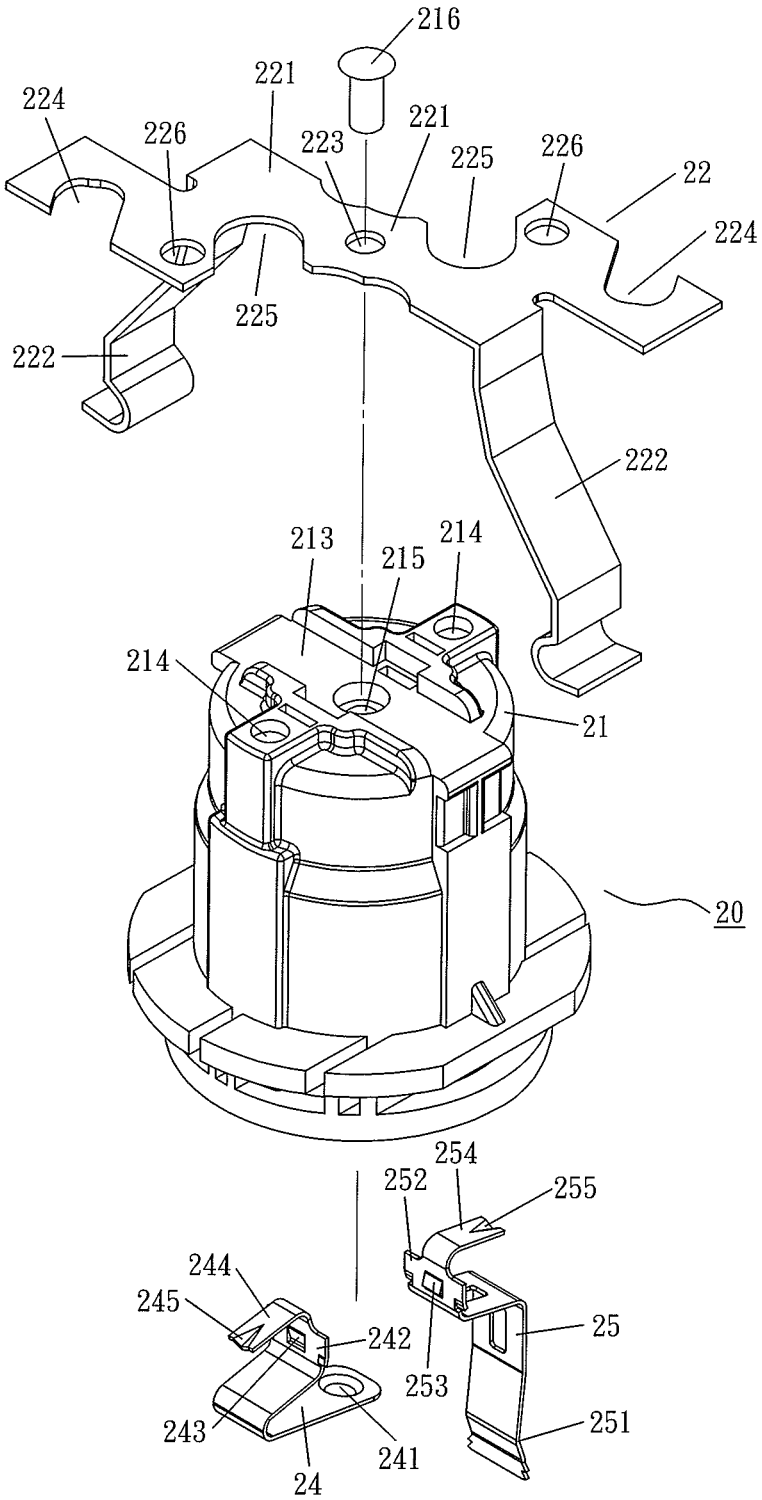
FIG. 3 is an exploded view of an embodiment of the present invention viewing from the top.

The technical characteristics, contents, advantages and effects of the present invention will be apparent with the detailed description of a preferred embodiment accompanied with related drawings as follows.

With reference to FIGS. 3 to 6 for an E26 plastic lampholder 20 of an embodiment of the present invention, the E26 plastic lampholder 20 comprises a housing 21, a plastic bracket 22, a plastic threaded ring 23, a positive electrode plate 24 and a negative electrode plate 25.

Figure 4:
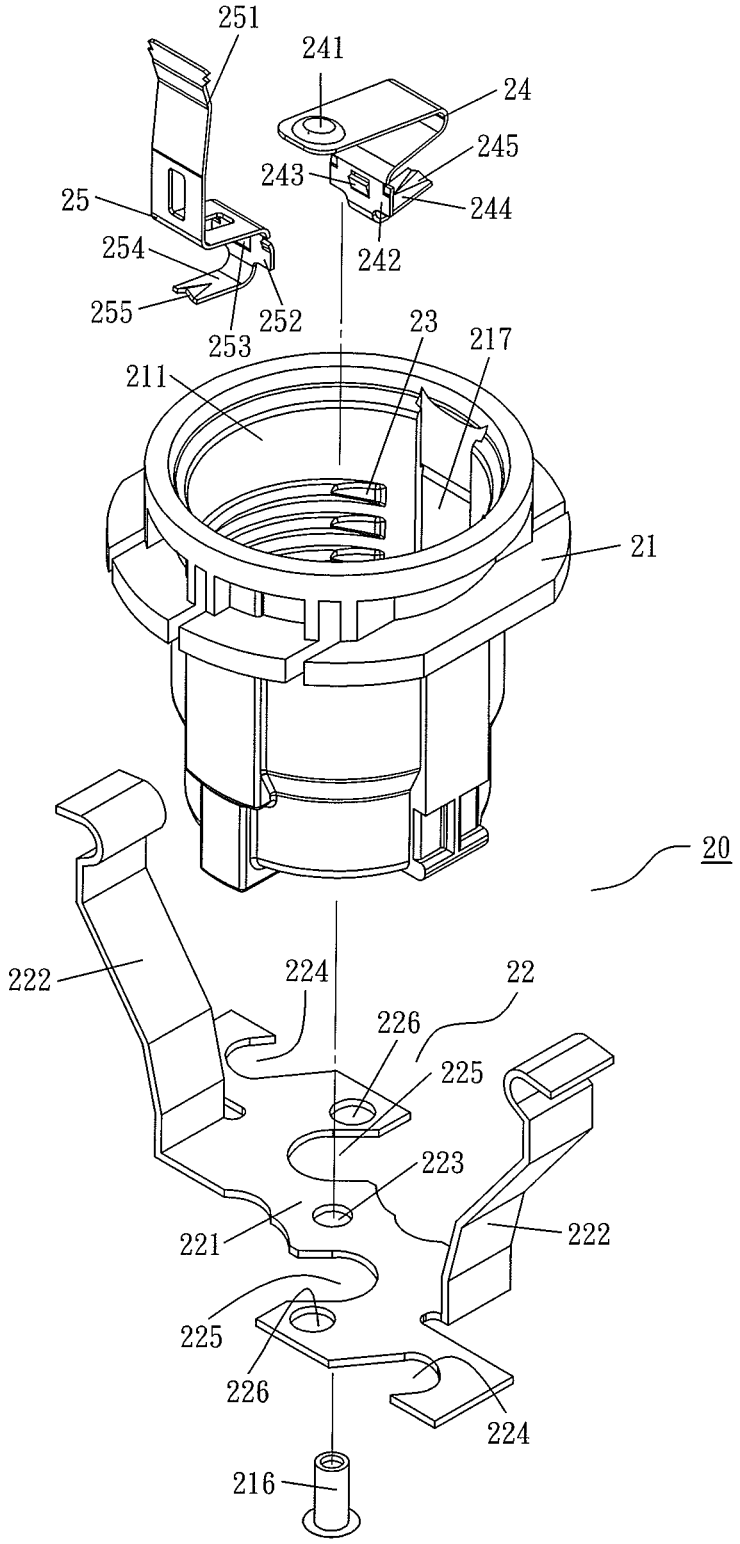
FIG. 4 is an exploded view of an embodiment of the present invention viewing from the bottom.
Figure 6:
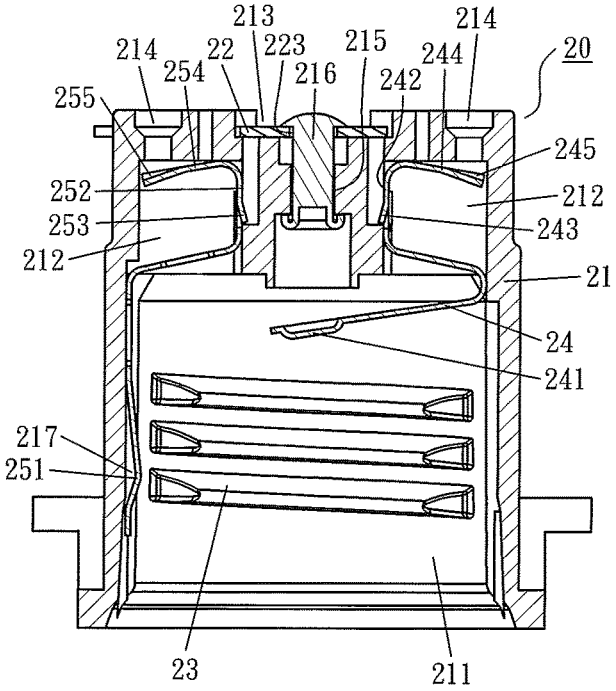
FIG. 6 is a sectional side view of an embodiment of the present invention.
Figure 7:
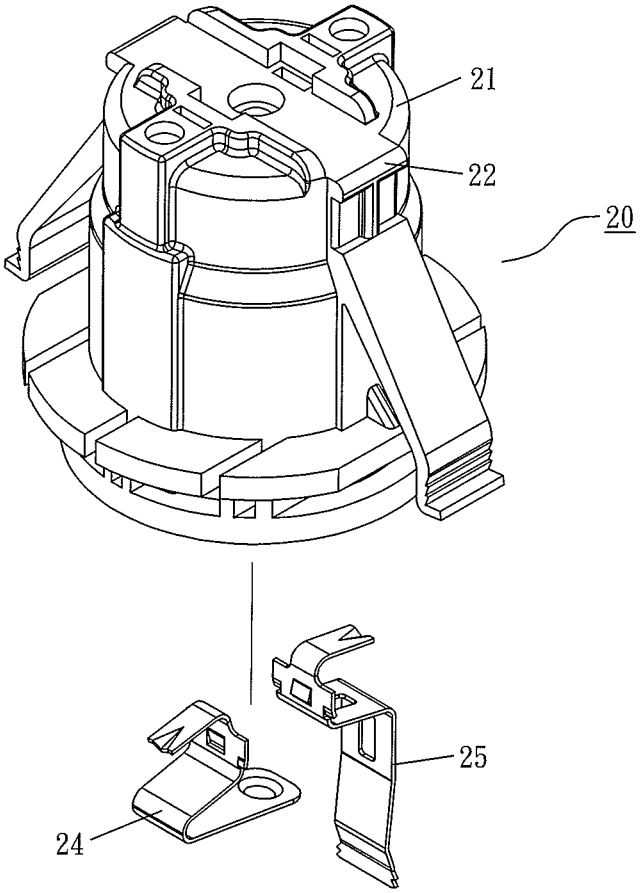
FIG. 7 is an exploded view of another embodiment of the present invention viewing from the top.
Figure 8:
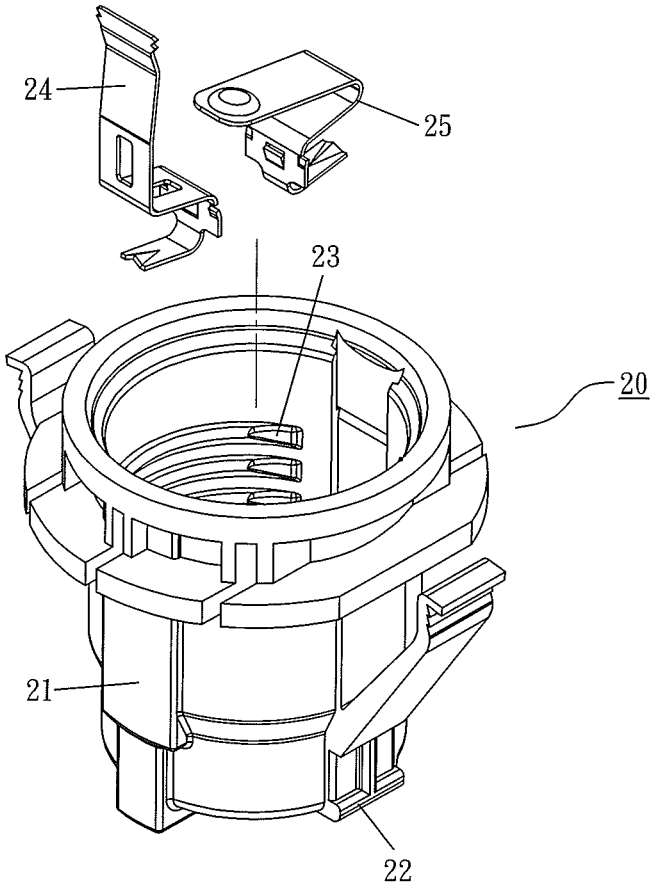
FIG. 8 is an exploded view of another embodiment of the present invention viewing from the bottom.
Figure 9:
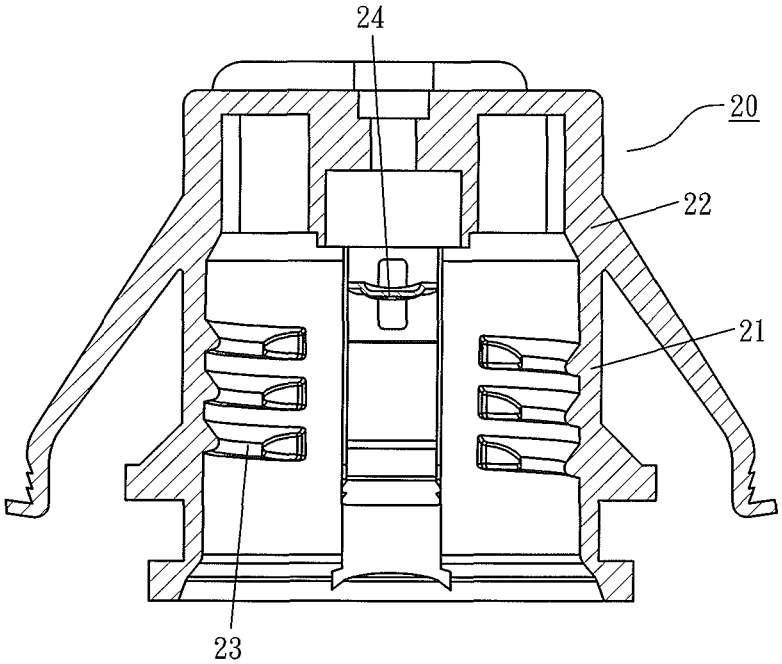
FIG. 9 is a sectional front view of another embodiment of the present invention.
Figure 10:
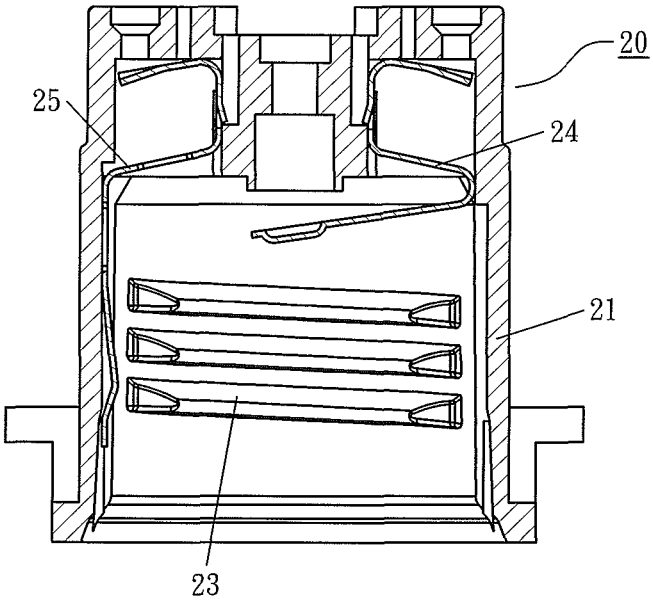
FIG. 10 is a sectional side view of another embodiment of the present invention.

The housing 21 is made of a plastic material and has an opening bottom inwardly penetrated to form an accommodating space 211 and two latch slots 212 symmetrically formed at the inner top of the housing 21 (as shown in FIG. 6), and the top of the housing 21 is a solid wall, and a horizontal combining groove 213 is formed at the middle of the housing 21, and two combining slots 215 are formed on both sides of the wire plug slot 214 respectively and disposed at the center of the housing 21, and the combining slots 215 are provided for passing and installing a respective engaging member 216 (such as a screw or a rivet), and the wire plug slots 214 are configured and communicated with a respective latch slot 212 separately. In other words, each wire plug slot 214 is interconnected to a latch slot 212, and a vertical shallow groove 217 is concavely formed on an internal wall of the housing 21 (as shown in FIGS. 4 and 6).

The plastic bracket 22 is made of a plastic material and has a horizontal roof portion 221, two elastic board parts 222 extended to both sides of the plastic bracket 22 respectively and a combining perforation 223 disposed at the center of the plastic bracket 22. The combining perforation 223 is configured to be corresponsive to the combining slot 215 and the engaging member 216. The plastic bracket 22 further comprises components including a hook slot 224, a circular hook notch 225 and a connecting hole 226 disposed at appropriate positions respectively.

The plastic threaded ring 23 is a deep threaded notch formed on an internal wall of the housing 21 and integrally formed with the housing 21. However, the plastic threaded ring 23 is not formed at a position of the internal wall of the housing 21 where the shallow groove 217 is formed (as shown in FIGS. 4 and 6). In other words, the plastic threaded ring 23 breaks its extension at the position where the shallow groove 217 is situated and recurs after passing through the shallow groove 217.

The positive electrode plate 24 is made of an electrically conductive material and has a conductive protruding portion 241 and makes an arc turn with an angle substantially equal to (or smaller than) 180° after being extended for a small section and then bent upwardly to form a vertical wall 242 after being extended for a small section, and a stop plate 243 is stamped on the vertical wall 242, and an upper end of the vertical wall 242 is turned in an opposite direction and extended to form a slantingly installed electric connection plate 244, and a latch recess 245 is stamped and formed at the front end of the vertical wall 242.

The negative electrode plate 25 is made of an electrically conductive material and has a conductive bent portion 251 which is bent inwardly for a small section after being stretched upwardly, and then bent upwardly to form a vertical wall 252, and a stop plate 253 is stamped and formed on the vertical wall 252, and an upper end of the vertical wall 252 is turned in an opposite direction and extended to form a slantingly installed electric connection plate 254, and a latch recess 255 is stamped and formed at a front end of the vertical wall 252.

Figure 5:
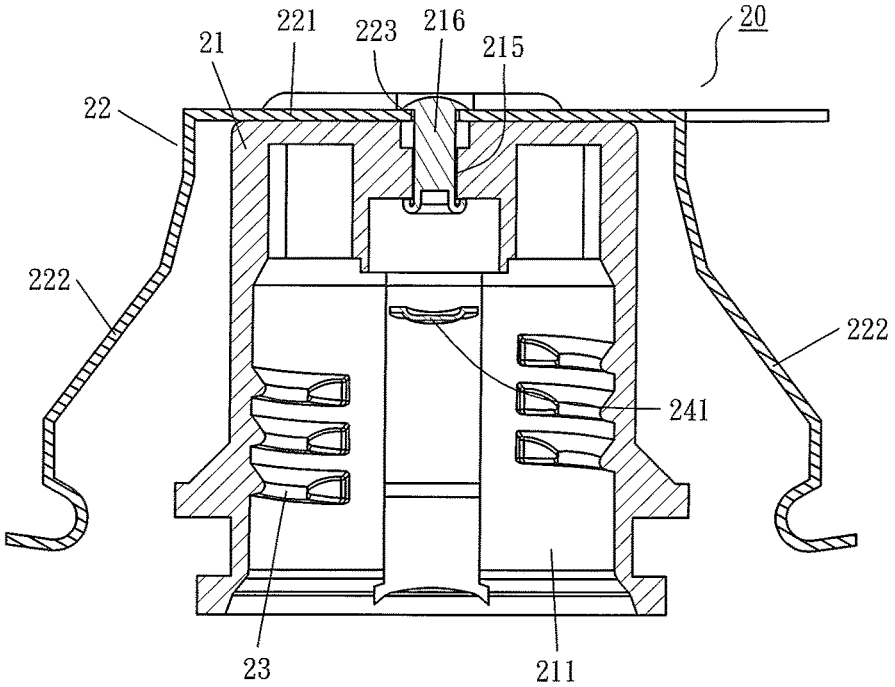
FIG. 5 is a sectional front view of an embodiment of the present invention.

During assembling, the roof portion 221 of the plastic bracket 22 is accommodated and positioned in the combining groove 213 of the housing 21. Now, the combining perforation 223 of the plastic bracket 22 is aligned precisely with the combining slot 215 of the housing 21, so that the engaging member 216 (such as a screw or rivet) may be passed through the combining perforation 223 and the combining slot 215 and a force may be applied for the connection, so as to securely connect the plastic bracket 22 with the housing 21. Now, the two elastic board parts 222 of the plastic bracket 22 are externally and slantingly extended to both sides of the housing 21 (as shown in FIG. 5).

The positive electrode plate 24 is installed and accommodated in the accommodating space 211 of the housing 21, and the electric connection plate 244 and the vertical wall 242 enter into one of the latch slots 212. Now, the latch recess 245 of the electric connection plate 244 is aligned precisely with one of the wire plug slots 214, and the stop plate 243 of the vertical wall 242 abuts at a recess formed on the wall of the latch slot 212 to stop the positive electrode plate 24 from separating in a downward direction. In the meantime, the conductive protruding portion 241 on the positive electrode plate 24 is extended to the center of the top of the accommodating space 211.

The negative electrode plate 25 is installed and accommodated in the accommodating space 211 of the housing 21, and the electric connection plate 254 and the vertical wall 252 enter into the other latch slot 212. Now, the latch recess 255 of the electric connection plate 254 is aligned precisely with another wire plug slot 214, and the stop plate 253 on the vertical wall 252 abuts at a recess formed on a wall of the latch slot 212 to stop the negative electrode plate 25 form separating in a downward direction. In the meantime, the plate with the conductive bent portion 251 of the negative electrode plate 25 extends downwardly and stays in the shallow groove 217 of the housing 21 (as shown in FIG. 6).

When the E26 plastic lampholder 20 is assembled into the accommodating slot at the top of the lamp body of a downlight, the elastic board parts 222 disposed on both sides of the plastic bracket 22 are extended outwardly and coupled to a wall of the accommodating slot formed at the top of the lamp body, so that the E26 plastic lampholder 20 is secured to the accommodating slot formed at the top of the lamp body. However, the assembling environment of an actual installation varies in different cases, so that components such as a hook slot 224, a circular hook notch 225 and/or a connecting hole 226 may be applied to the plastic bracket 22 to facilitate the assembling or provide a more secured installation.

After the E26 plastic lampholder 20 is assembled with the lamp body to form a downlight, the whole downlight may be installed to a ceiling for use. The hard bare line sections of the two electrodes of a power line connected to the mains power may be plugged into the wire plug slots 214 respectively, and the bare line sections of the two electrodes of the power line touch the latch recess 245 of the positive electrode plate 24 and the latch recess 255 of the negative electrode plate 25 respectively, and then a force may be apply to press the bare line sections of the two electrodes of the power line into the wire plug slots 214 further, and the two bare line sections will press the electric connection plate 244 of the positive electrode plate 24 and the electric connection plate 254 of the negative electrode plate 25 to bent inwardly, so that the two bare line sections are in contact and scratch through the latch recesses 245, 255 to enter into the latch slots 212. When the force is released, the resilience of the electric connection plates 244, 254 drives the latch recesses 245, 255 together with the walls of the latch slots 212 to clamp the two bare line sections securely, so that the electrodes of the power line connected to the mains power are electrically conducted with the positive electrode plate 24 and the negative electrode plate 25, and the threaded joint screw of the light bulb of the cold light illumination series (such as a power saving fluorescent light bulb or an LED light bulb) enters into the plastic threaded ring 23 until the top of the threaded joint reaches deeply into the conductive protruding portion 241 of the positive electrode plate 24, so that the top of the threaded joint is electrically conducted with the positive electrode plate 24. In the meantime, the threaded portion of the threaded joint is electrically conducted with the plastic threaded ring 23 and the conductive bent portion 251 of the negative electrode plate 25, so that the power saving fluorescent light bulb or the LED light bulb will be lit.

With reference to FIGS. 7 to 10 for another embodiment of the present invention, the housing 21, the plastic bracket 22 and the plastic threaded ring 23 of the E26 plastic lampholder 20 are made of a plastic material and integrally formed by the same manufacturing principles and effects, and then the positive electrode plate 24 and the negative electrode plate 25 are installed to complete the assembling of the E26 plastic lampholder 20. Therefore, the step of assembling the housing 21 and the plastic bracket 22 can be skipped. The positive electrode plate 24 and the negative electrode plate 25 can be assembled directly according to the aforementioned assembling process.

In summation of the description above, the E26 plastic lampholder 20 of the present invention can be assembled and used easily, since the two electrodes of the power line can be plugged into the wire plug slots 214 through the bare line sections. Therefore, the E26 plastic lampholder 20 can be installed without requiring any screw or rivet. Particularly, the plastic bracket 22 and the housing 21 are made of a plastic material, so that the manufacture is simpler and easier, and the combining groove 213 reserved on the housing 21 is provided for accommodating and positioning the plastic bracket 22, or the housing 21, the plastic bracket 22 and the plastic threaded ring 23 are integrally formed to make the assembling and operating processes more conveniently. In addition, the plastic threaded ring 23 may be directly and integrally formed into the housing 21 to make the manufacturing and assembling processes more conveniently.

While the invention has been described by means of specific embodiments, numerous modifications and variations could be made thereto by those skilled in the art without departing from the scope and spirit of the invention set forth in the claims.

What is claimed is:

1. An E26 plastic lampholder, comprising a housing, a plastic bracket, a plastic threaded ring, a positive electrode plate and a negative electrode plate, characterized in that the housing is made of a plastic material and has an opening bottom inwardly penetrated to form an accommodating space, two latch slots symmetrically formed at an inner top of the housing, two wire plug slots formed on both sides of a top of the housing respectively and communicated with the latch slots separately, and a vertical shallow groove concavely formed on an internal wall of the housing; the plastic bracket is made of a plastic material and comprises a horizontal roof portion and two elastic board parts extended from both sides of the horizontal roof portion, and the roof portion is coupled to the top of the housing, so that the two elastic board parts are slantingly extended along both sides of the housing respectively; the plastic threaded ring is a threaded notch integrally formed on an internal wall of the housing and the plastic threaded ring breaks its extension at the shallow groove and recurs after crossing the shallow groove; the positive electrode plate is made of an electrically conductive material and has a conductive protruding portion which makes an are turn of substantially 180 degree after extending for a small section and then bends upwardly to form a vertical wall after extending for a small section, and a stop plate is stamped on the vertical wall, and an upper end of the vertical wall is turned in the opposite direction and extended to form an slantingly installed electric connection plate, and a latch recess is stamped at the front end of the electric connection plate, and the positive electrode plate is accommodated in the accommodating space of the housing, so that the electric connection plate and the vertical wall enter into one of the latch slots, and the latch recess of the electric connection plate is aligned precisely with one of the wire plug slots, and the stop plate on the vertical wall abuts against the latch slot wall to stop and position the positive electrode plate, while the conductive protruding portion on the positive electrode plate is extended to the center of an upper portion of the accommodating space; the negative electrode plate is made of an electrically conductive material and has a conductive bent portion which is bent and extended for a small section after being stretched upwardly, and then further bent upwardly to form a vertical wall, and a stop plate is stamped on the vertical wall of the negative electrode plate, and an upper end of the vertical wall of the negative electrode plate is then turned in the opposite direction and extended to form a slantingly installed electric connection plate, and a latch recess is stamped from a front end of the electric connection plate of the negative electrode plate, and the negative electrode plate is accommodated in the accommodating space of the housing, so that the electric connection plate of the negative electrode plate and the vertical wall enter into another latch slot, and the latch recess on the electric connection plate of the negative electrode plate is aligned precisely with the other wire plug slot, and the stop plate on the vertical wall of the negative electrode plate abuts against the latch slot wall to stop and position the negative electrode plate while a plate disposed on the negative electrode plate and at a position where the conductive bent portion is disposed extends downwardly and stays in the shallow groove of the housing.

2. The E26 plastic lampholder of claim 1, wherein the housing has a horizontal combining groove formed in the middle of the top of the housing and a combining slot formed at the center of the housing, and the plastic bracket has a combining perforation formed at the center of the plastic bracket, and the roof portion of the plastic bracket is contained in the combining groove of the housing, so that the combining perforation of the plastic bracket is aligned precisely with the combining slot of the housing, and an engaging member is passed through the combining perforation and the combining slot to couple the plastic bracket with the housing.

3. The E26 plastic lampholder of claim 1, wherein the housing, the plastic bracket, and the plastic threaded ring are made of a plastic material and integrally formed with one another.

* * * * *